United States Patent [19]

Gernhardt et al.

[11] 4,416,732

[45] Nov. 22, 1983

[54] HORIZONTAL COKE OVEN BATTERY

[75] Inventors: Paul Gernhardt; Heinz Thubeauville; Carl-Heinz Struck, all of Bochum, Fed. Rep. of Germany

[73] Assignee: Dr. C. Otto & Comp. G.m.b.H., Bochum, Fed. Rep. of Germany

[21] Appl. No.: 354,818

[22] Filed: Mar. 4, 1982

[30] Foreign Application Priority Data

Apr. 9, 1981 [DE] Fed. Rep. of Germany ..... 3114340
Jun. 4, 1981 [DE] Fed. Rep. of Germany ..... 3122112

[51] Int. Cl.[3] ..... C10B 21/12; C10B 21/16
[52] U.S. Cl. ..... 202/139; 202/151
[58] Field of Search ..... 202/139, 141–144, 202/151

[56] References Cited

U.S. PATENT DOCUMENTS 3,689,365 9/1972 Steding et al. ..... 202/139
3,801,470 4/1974 Knappstein et al. ..... 202/151
4,004,983 1/1977 Pries ..... 202/142
4,244,786 1/1981 Thubeauville ..... 202/142
4,329,203 5/1982 Faber et al. ..... 202/151

FOREIGN PATENT DOCUMENTS 1059404 6/1959 Fed. Rep. of Germany ..... 202/141

*Primary Examiner*—Bradley Garris
*Attorney, Agent, or Firm*—Thomas H. Murray

[57] ABSTRACT

A horizontal coke oven battery in which heating chambers between coking chambers are divided by midfeathers or header walls into vertically-extending heating flues. Extending upwardly through the midfeathers are feed flues which communicate with the regenerators of the coke oven battery and have feed flue outlets disposed at different heights in the heating flues. In this invention, the feed flue outlets comprise one or more vertically-extending elongated slots which facilitate "soft" combustion and flame formation, greatly reducing temperature peaks and nitrogen oxide formation.

11 Claims, 5 Drawing Figures

HORIZONTAL COKE OVEN BATTERY

BACKGROUND OF THE INVENTION

The present invention relates to a coke oven battery of the type which can be heated by either lean gas or rich gas by means of vertically-extending heating flues disposed in rows between oven chambers. The vertically-extending flues in each row are formed by midfeaters or header walls in heating chambers and are provided with vertically-extending feed flues which conduct air and/or lean gas to feed flue outlets communicating with the heating flues.

In the past, arrangements such as that shown in U.S. Pat. No. 4,004,983 have been provided wherein a plurality of vertically-spaced feed flue outlets have cross sections which increase or decrease in the vertical direction. These slots are typically transverse slots in prior-art ovens. Transversely-extending slots, however, lead to the formation of relatively "tight" flames with an excessive local evolution of heat and corresponding generation of nitrogen oxides, particularly in the case of rich-gas heating. It is possible for some of the resulting flue gas to be recycled between two adjacent heating flues when employing rich-gas heating in order to obviate temperature peaks. The disadvantage of this procedure, however, is that the quantity of recycled gas can be determined only approximately by means of predetermined orifice configurations. Also, additional energy supplied, for example, by a blower is required to circulate the gas.

SUMMARY OF THE INVENTION

In accordance with the present invention, the problems of "tight flames" and excessive generation of nitrogen oxides are obviated by providing feed flue outlets in the midfeathers which are vertically elongated. Either a plurality of vertical slots may be spaced along the feed flues in the midfeathers or a single vertically-extending slot can be provided along the entire length of the feed flue. By using vertically-elongated slots as described herein, mixing of the combustion gas is spread vertically. This results in "soft" combustion and flame formation, thus greatly reducing temperature peaks and nitrogen oxide formation.

The above and other objects and features of the invention will become apparent from the following detailed description taken in connection with the accompanying drawings which form a part of this specification, and in which.

Figure 1:
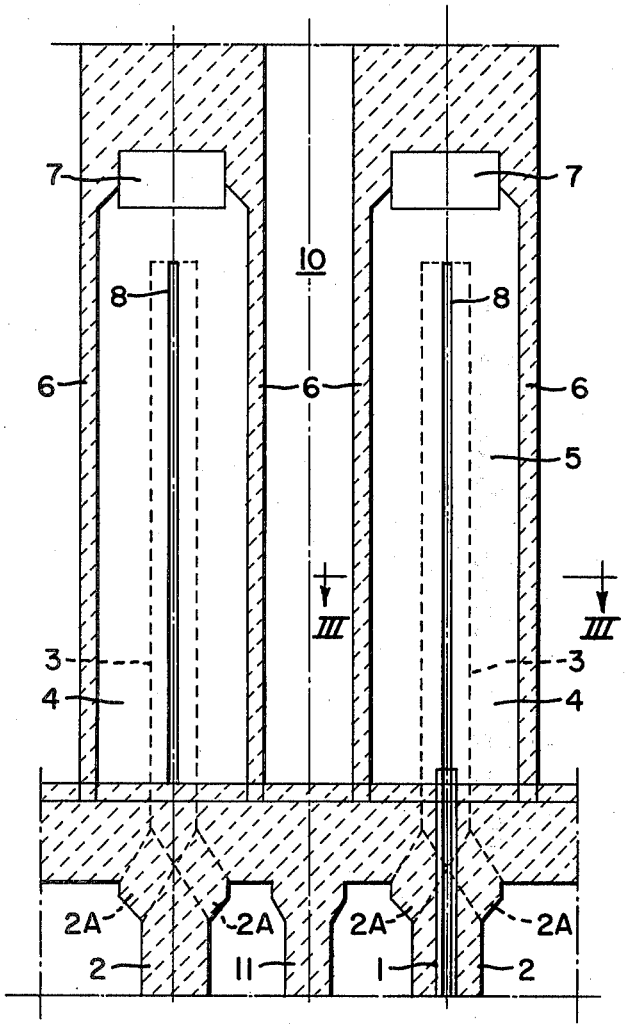
FIG. 1 is a vertical cross-sectional view, parallel to the midfeathers, through two heating flues of a coke oven battery showing one embodiment of the invention.
Figure 3:
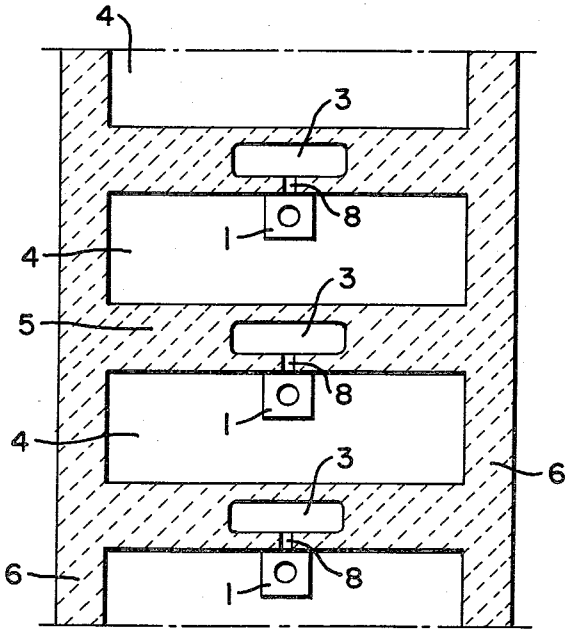
FIG. 3 is a cross-sectional view taken substantially along line III—III of either FIG. 1 or FIG. 2.

With reference now to the drawings, and particularly to FIG. 1, there is shown one of a plurality of coke oven chambers 10 in a battery with side walls 6 which are heated by rows of heating flues 4. The heating flues 4 are formed between the side walls 6 and are separated by means of refractory inner walls or midfeathers 5 (FIG. 3). Extending upwardly through the midfeathers 5 are feed flues 3 which, in the case of rich-gas burning, conduct combustion-supporting air which has been preheated in regenerators 2 to the heating flues 4 through passageways 2A. The heating flues shown are of the twin-flue type, adjacent flues being interconnected by means of crossover passageways 7.

Beneath each of the coking chambers 10 is a support wall 11. Assuming that rich-gas heating is employed, the rich gas enters the heating flues through rich-gas burners 1, this rich gas being mixed with the air entering the heating flues 4 from the feed flues 3 through one or more feed flue outlets 8 or 8A. In the embodiment of the invention shown in FIG. 1, the feed flue outlets 8 are continuous and extend along the entire lengths of the feed flues 3. On the other hand, in the embodiment of FIG. 2, the outlets comprise separated, vertical slots 8A separated by masonary areas 9. In either case, the width of the gap or gaps formed by the slots can increase or decrease upwardly along their vertical lengths to insure satisfactory treatment of locally necessary partial flows of combustion-supporting air and to provide fine control of the air supply. Gap width can increase or decrease steplessly or in steps, a step usually corresponding to one or more courses of the masonry forming the midfeather. By providing vertically-extending slots to form the flue outlets 8 or 8A, a much softer flame is produced in the heating flues which minimizes temperature peaks and the formation of nitrogen oxides. As can be seen from the drawings, FIGS. 1 and 2, the transverse widths of slots 8 or 8A is much less than their vertical heights.

Figure 4:
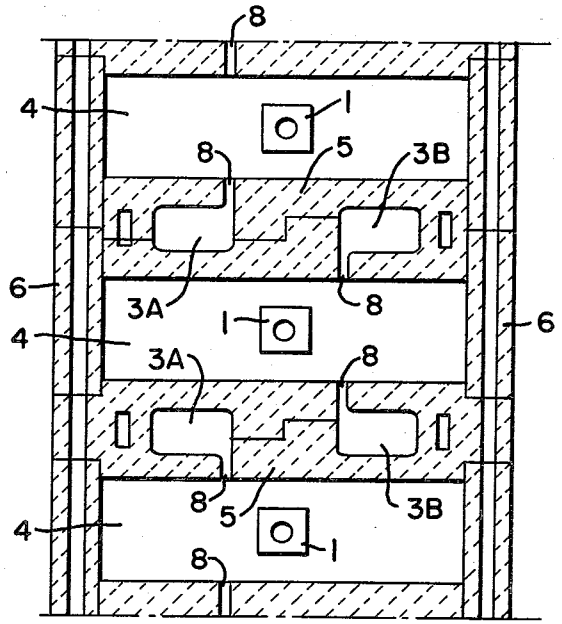
FIG. 4 is a cross-sectional view similar to that of FIG. 3 but illustrating a further embodiment of the invention.

In FIG. 4, an embodiment of the invention is shown for use with lean-gas heating. In this case, there is formed in each midfeather 5 two feed flues 3A and 3B both having slots 8 communicating with adjacent heating flues 4 on opposite sides of the midfeather. When lean-gas heating is utilized, one of the feed flues 3A or 3B of each midfeather is supplied with air preheated in the regenerators; while the feed flue in the adjacent midfeather 5 is supplied with preheated lean gas such that air and lean gas enter the heating flues 4 through opposite slots in facing midfeathers. Again, the slots 8 in the embodiment of FIG. 4 are vertically elongated so as to produce a "soft" flame which minimizes temperature peaks and the formation of nitrogen oxides.

Figure 5:
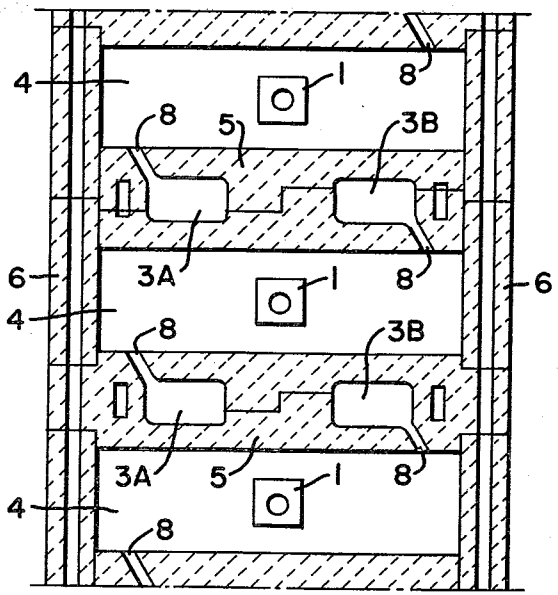
FIG. 5 is a cross-sectional view similar to that of FIGS. 3 and 4 illustrating still a further embodiment of the invention.

In FIG. 5, still another embodiment of the invention is shown for use with either lean- or rich-gas heating. In the case of rich-gas heating, the rich gas is again supplied to the flues by means of a central rich-gas burner 1; while air from the regenerators is supplied through diagonally-opposite slots 8 communicating with each heating flue 4. The slots 8 in the embodiment of FIG. 5 are arranged such that the heated air impinges on the side walls 6 and produces a circulatory motion of air within the heating flues 4 with a consequent improvement in fuel-air mixing and combustion.

When using the embodiment of FIG. 5 for lean-gas heating, one of the two feed flues 3 in each midfeather is supplied with air and the other with lean gas such that the air and lean gas enter at diagonally-opposite points in each heating flue 4. The entering air and lean gas again produce a swirling motion with a consequent improvement in mixing and combustion.

Figure 2:
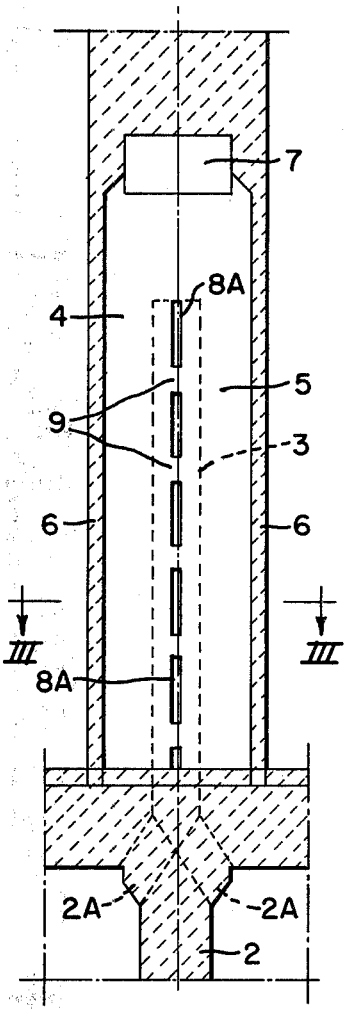
FIG. 2 is a longitudinal cross-sectional view similar to that of FIG. 1 but showing a single heating flue incorporating another embodiment of the invention.

Instead of having straight side walls, the slots 8 can be of variable cross-sectional area along their lengths as viewed in FIGS. 3–5 with the larger cross-sectional area being near either the feed flue 3 or the adjacent heating flue 4. Also, in FIGS. 4 and 5, the slots 8 can be continuous or segmented as shown in FIG. 2.

Although the invention has been shown in connection with certain specific embodiments, it will be readily apparent to those skilled in the art the various changes in form and arrangement of parts may be made to suit requirements without departing from the spirit and scope of the invention. In this regard, it will be appreciated that the feed flues 3, instead of being incorporated into the midfeathers, can be built up separately from the midfeathers in the various heating flues.

We claim as our invention:

1. In a horizontal coke oven battery in which heating chambers between coking chambers are divided by midfeathers into heating flues, the combination of feed flues extending upwardly through the heating chambers, said feed flues communicating with regenerators for the coke oven battery, and feed flue outlets connecting the feed flues to the heating flues, said feed flue outlets each comprising vertically-elongated slot means extending along substantially the the entire length of an associated feed flue to facilitate soft combustion and flame formation, thereby greatly reducing temperature peaks and nitrogen oxide formation.

2. The horizontal coke oven battery of claim 1 wherein a single vertically-elongated slot extends along substantially the entire length of each feed flue for connecting the feed flue to an associated heating flue.

3. The horizontal coke oven battery of claim 1 in which there is a plurality of vertically-elongated slots spaced along substantially the entire length of each feed flue for connecting said feed flue to an associated heating flue.

4. The horizontal coke oven battery of claim 3 wherein said feed flue outlet slots have widths which vary along the vertical lengths of the slots.

5. The horizontal coke oven battery of claim 4 wherein the widths of said slots vary steplessly.

6. The horizontal coke oven battery of claim 4 wherein the widths of said slots vary in steps.

7. The horizontal coke oven battery of claim 1 wherein said feed flues extend upwardly through said midfeathers.

8. The horizontal coke oven battery of claim 7 wherein there are two feed flues in each midfeather, the feed flue outlet for one feed flue communicating with one heating flue while the feed flue outlet for the other feed flue communicates with an adjacent heating flue.

9. The horizontal coke oven battery of claim 8 wherein said feed flue outlets are at opposite portions of each heating flue.

10. The horizontal coke oven battery of claim 9 wherein the opposite feed flue outlets are angled to direct gas from their associated feed flues onto side walls for the heating flues.

11. The horizontal coke oven battery of claim 1 wherein said feed flues are built up by masonry separate and apart from the midfeathers.

* * * * *